United States Patent [19]

Budzich

[11] 4,327,763

[45] May 4, 1982

[54] DUAL CONTROL INPUT FLOW CONTROL VALVE

[76] Inventor: Tadeusz Budzich, 80 Murwood Dr., Moreland Hills, Ohio 44022

[21] Appl. No.: 210,518

[22] Filed: Nov. 28, 1980

Related U.S. Application Data

[63] Continuation-in-part of Ser. No. 111,194, Jan. 11, 1980.

[51] Int. Cl.[3] ..... F15B 13/04

[52] U.S. Cl. ..... 137/117; 91/451; 137/596.13

[58] Field of Search ..... 91/446, 448, 451; 137/596, 596.13, 117

[56] References Cited

U.S. PATENT DOCUMENTS 4,153,075 5/1979 Budzich ..... 137/596.13
4,282,898 8/1981 Harmon ..... 137/596.13

*Primary Examiner*—Gerald A. Michalsky

[57] ABSTRACT

A pilot operated flow control valve of a bypass type, which automatically regulates the quantity of flow delivered to the control orifice to maintain a relatively constant pressure differential between the supply pressure and the load pressure and which permits variation in the level of pressure differential in response to an external control signal while this pressure differential is maintained constant at each controlled level.

11 Claims, 2 Drawing Figures

DUAL CONTROL INPUT FLOW CONTROL VALVE

This is a continuation in part of application Ser. No. 111,194, filed Jan. 11, 1980, for "Load Responsive Fluid Control Valve."

BACKGROUND OF THE INVENTION

This invention relates generally to flow control valves regulating, irrespective of variations in system pressure, the quantity of fluid flow to a load.

In more particular aspects this invention relates to flow control valves of a bypass type.

In still more particular aspects this invention relates to flow control valves, in which the bypass member is controlled by a pilot valve.

In still more particular aspects this invention relates to pilot operated flow control valves of a bypass type, which permit variation in the controlled pressure differential between valve inlet pressure and the load pressure, in response to an external control signal.

The flow control valves of a throttling or bypass type regulate the flow of fluid to a load by automatically maintaining a constant pressure differential across an orifice leading to the load. The quantity of the flow is varied by the area of orifice, each area corresponding to a specific flow to the load, irrespective of the variations in the system pressure. Because of the influence of flow forces on the quantity of the controlled flow, the controlled constant pressure differential is usually selected quite high, providing a comparatively large throttling loss and therefore affecting the system efficiency. The forces necessary to vary the area of the orifice vary with the size of the valve and are usually quite high.

SUMMARY OF THE INVENTION

It is therefore a principal object of this invention to provide a flow control valve of a bypass type, which permits variation in the level of control differential between valve supply pressure and load pressure, while this control differential is automatically maintained constant at each controlled level.

Another object of this invention is to provide controls of flow control valve of a bypass type, through which control of flow to system load can be either accomplished by variation in area of the orifice, between the valve control and a fluid motor, while the pressure differential across this orifice is maintained constant at a specific level, or by control of pressure differential, acting across this orifice, while the area of the orifice remains constant.

It is a further object of this invention to provide flow control valve of a bypass type, which permits variation in the controlled pressure differential across a metering orifice in response to an external control signal at a minimum force level.

It is a further object of this invention to provide controls of flow control valve of a bypass type, which modify control signals, supplied to pilot operated valve controls, to control the pressure differential across an orifice leading to the load.

It is a further object of this invention to provide controls of flow control valve of a bypass type, which modify control signals, supplied at minimum energy level, to the amplifying stage of the valve controls, to control pressure differential across an orifice leading to the load.

Briefly the foregoing and other additional objects and advantages of this invention are accomplished by providing novel flow controls of a flow control valve, to bypass fluid supplied from the pump either in response to one control input, namely variation in the area of metering orifice, to control a constant pressure differential, at a preselected level between valve inlet pressure and the load pressure, or in response to another control input, namely modification in the pressure of control signal, to vary the level of the control differential between valve inlet pressure and the load pressure, while this control differential is automatically maintained constant at each controlled level by the valve controls receiving low energy control signals to their amplifying stage. In this way a load can be controlled in response to either input providing identical control performance, or the variable pressure differential control can be superimposed on the control action controlling fluid flow by variation in the area of the metering orifice.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
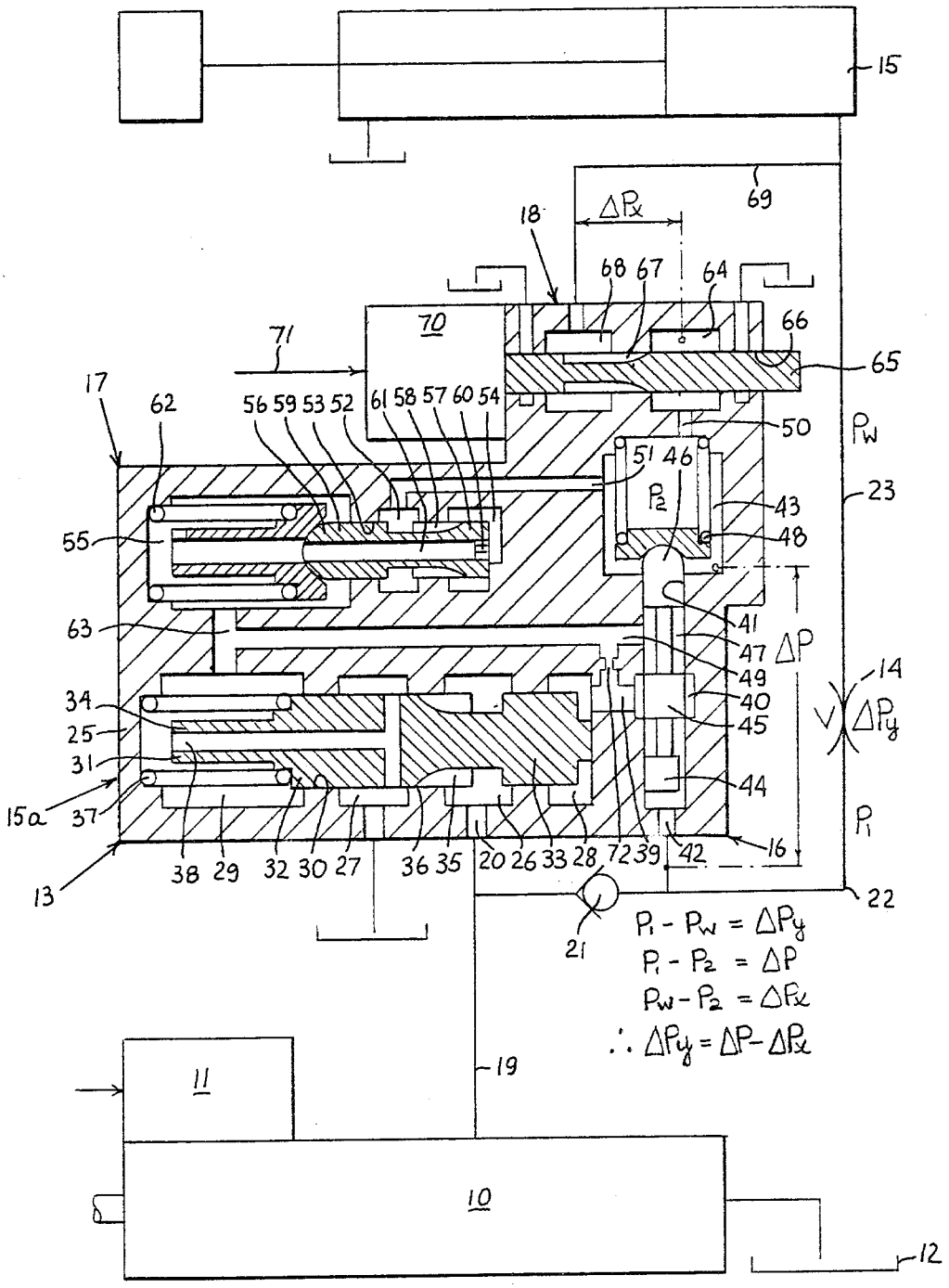
FIG. 1 is a diagrammatic representation of a pilot operated flow control valve provided with adjustment in the level of control differential from a certain preselected level to zero level, with fluid motor and system pump shown schematically.

Referring now to FIG. 1, the hydraulic system shown therein comprises a fluid pump 10, which may be provided with an output flow control 11, connected to a reservoir 12. The fluid pump 10 is preferably of a fixed displacement type. The fluid pump 10 supplies pressure fluid into a fluid power circuit, composed of a differential bypass control, generally designated as 13, regulating the level of the pressure differential developed across schematically shown variable orifice 14, interposed between the pump 10 and a fluid motor 15, operating load W. With pump 10 being of fixed displacement type the differential bypass control 13 bypasses a portion of flow delivered from the pump 10 to the reservoir 12, to regulate the pressure differential across variable orifice 14. The output flow control 11 of the pump 10 may be a conventional maximum pressure relief valve, well known in the art. The differential bypass control 13 is composed of bypass section, generally designated as 15*a*, a pilot section, generally designated as 16, a flow control section, generally designated as 17 and a signal throttling section, generally designated as 18.

Discharge line 19 of pump 10 is connected to port 20 of differential bypass control 13 and through a check valve 21, line 22, variable orifice 14 and line 23 is also connected to the fluid motor 15. The fluid motor 15 is also connected by lines 23 and 69 with the differential bypass control, generally designated as 13.

The bypass section 15*a* of the differential bypass control 13 comprises a housing 25 having an inlet chamber 26, a bypass chamber 27, first control chamber 28 and an exhaust chamber 29, all of those chambers being connected by bore 30, slidably guiding a bypass spool 31. The bypass spool 31, equipped with lands 32 and 33 and stop 34, is provided with throttling slots 35, terminated in cut-off edges 36, between the inlet chamber 26 and the bypass chamber 27. One end of the bypass spool 31 projects into the first control chamber 28, while the other end projects into the exhaust chamber 29 and is biased by a control spring 37. The exhaust chamber 29 is connected by passage 38 with the bypass chamber 27 and therefore with the system reservoir 12. The first control chamber 28 is connected by passage 39 with annular space 40 of the pilot valve section, generally designated as 16. Bore 41 connects annular space 40 with port 42 and a second control chamber 43 and axially guides a pilot valve spool 44. The pilot valve spool 44, equipped with metering land 45 and land 46, which define annular space 47, communicates with port 42 and projects into the second control chamber 43, where it engages a spring 48. Annular space 47 is connected by passage 49 with the exhaust chamber 29 and therefore the system reservoir 12. The second control chamber 43 is connected through passage 50 with the signal throttling section, generally designated as 18 and is also connected through passage 51 with the flow control section, generally designated as 17. Passage 51 connects the second control chamber 43 with a supply chamber 52, connected by bore 53 with a third control chamber 54 and an exhaust chamber 55. Bore 53 slidably guides a control spool 56, equipped with land 57, provided with throttling slots 58 and positioned between the supply chamber 52 and the third control chamber 54, a land 59 separating the supply chamber 52 and the exhaust chamber 55. The third control chamber 54 is connected by orifice 60 and passage 61 with the exhaust chamber 55, which contains a spring 62, biasing the control spool 56 and is connected by passage 63 with the exhaust chamber 29. The second control chamber 43 is connected by passage 50 with chamber 64, which is selectively interconnected by metering orifice created by a stem 65 guided in bore 66 and provided with metering slots 67, with signal chamber 68. Signal chamber 68 is connected by line 69 with the fluid motor 15. The stem 65 is connected to an actuator 70, responsive to external control signal 71. Exhaust chambers 55 and 29, connected to the system reservoir 12 are also connected by passages 63 and 49 and orifice 72 with passage 39.

Figure 2:
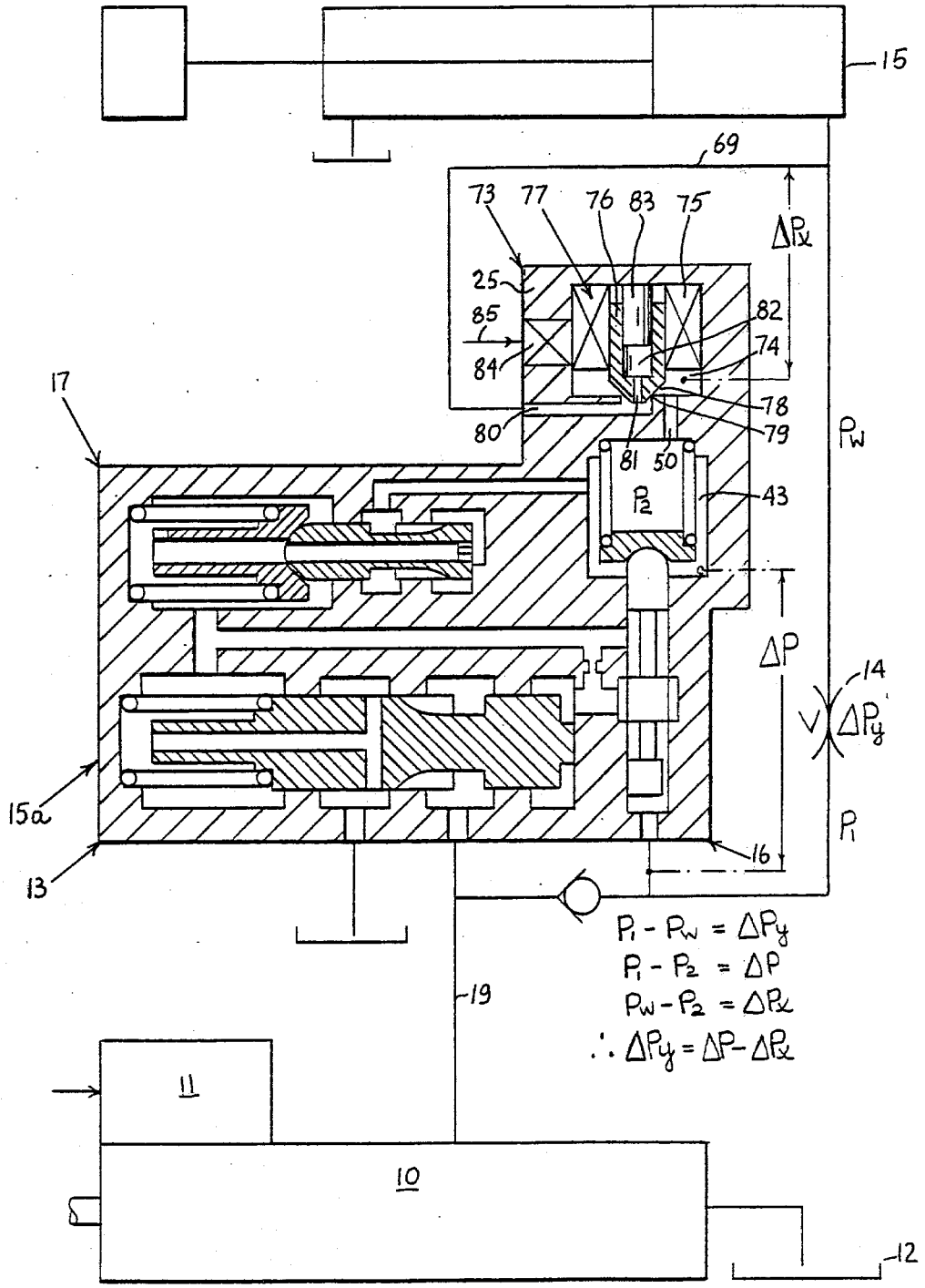
FIG. 2 is a diagrammatic representation of another embodiment of the pilot operated flow control valve of FIG. 1, with fluid motor and system pump shown schematically.

Referring now to FIG. 2 the differential bypass control, generally designated as 13, has bypass section 15*a*, pilot section 16 and flow control section 17 identical to those as shown in FIG. 1. A signal throttling section of FIG. 2, generally designated as 73, is different from the signal throttling section 18 of FIG. 1. The same components used in FIGS. 1 and 2 are designated by the same numerals. The second exhaust chamber 43 is connected by passage 50 to chamber 74 of the signal throttling section, generally designated as 73. The signal throttling section 73 comprises a coil 75 retained in the housing, which guides an armature 76 of a solenoid, generally designated as 77. The armature 76 is provided with conical surface 78, selectively engagable with sealing edge 79 of inlet port 80 and venting passage 81, terminating in bore 82, guiding a reaction pin 83. The coil 75 is connected by sealed connector 84 to outside of housing 25, external control signal 85 being applied to the sealed connector 84.

Referring now to FIG. 1, the differential bypass control 13 is introduced into a circuit between the pump 10 and fluid motor 15 and controls the fluid flow and pressure therebetween. The fluid motor 15 can be substituted by any device to which fluid flow must be controlled. The differential bypass control 13 is composed of the bypass section 15*a*, the pilot section 16, the flow control section 17 and the signal throttling section 18. The bypass section 15*a* with its bypass spool 31 throttles with throttling slots 35 fluid flow between the inlet chamber 26, connected by discharge line 19 to the pump 10 and the bypass chamber 27, connected to the system reservoir 12 to automatically maintain a constant pressure differential across variable orifice 14, connected by line 23 with the fluid motor 15. This control action is accomplished in the following way. Fluid from upstream of variable orifice 14 at $P_1$ pressure is supplied to port 42 where, reacting on the cross-sectional area of the pilot valve spool 44, generates a force tending to move the pilot valve spool 44 upward, to connect $P_1$ pressure through annular space 40 and passage 39 to the first control chamber 28 and therefore to increase the pressure level in the first control chamber 28. Fluid at load pressure Pw, which is the pressure acting down stream of variable orifice 14, is supplied by line 69 to the signal throttling section 18. With the stem 65 displaced to the right and the signal chamber 68 connected to the chamber 64 by metering slots 67 the fluid under $P_2$ pressure, which approximately equals Pw pressure, is supplied through passage 50 to the second control chamber 43 where, reacting on the cross-sectional area of the pilot valve spool 44, it generates a force tending to move the pilot valve spool 44 downward, to connect the reservoir pressure from annular space 47 to annular space 40, passage 39 and to the first control chamber 28 and therefore to decrease the pressure level in the first control chamber 28. This force, due to pressure in the second control chamber 43, is supplemented by the biasing force of the spring 48. Increase in pressure level in the first control chamber 28, above the level, equivalent to preload of the control spring 37, reacting on the cross-sectional area of the bypass spool 31, will generate a force tending to move the bypass spool 31 from right to left, in the direction of opening of the flow area through the throttling slots 35 and therefore in the direction of increasing the bypass flow by the throttling action of the bypass spool 31. Conversely, a decrease in pressure level in the first control chamber 28, below the level equivalent to preload of control spring 37, will result in the control spring 37 moving the bypass spool 31 from left to right, in the direction of decreasing the flow area through the throttling slots 35 and therefore in direction of decreasing the bypass flow by the throttling action of the bypass spool 31. Therefore by regulating the pressure level in the first control chamber 28 the pilot valve spool 44 will control the bypass action of the bypass spool 31 and the quantity of fluid flowing through variable orifice 14. Assume that the stem 65 is fully displaced to the right, providing a minimum resistance to the fluid flow from line 69 to the second control chamber 43. The pilot valve spool 44, subjected to $P_1$ and $P_2$ pressures and the biasing force of spring 48 will reach a modulating position, in which by throttling action of metering land 45 will regulate the pressure in the first control chamber 28 and therefore the bypass action of the bypass spool 31 to regulate the pump $P_1$ pressure which is higher, by a constant pressure differential $\Delta P$, than $P_2$ pressure and equal to the quotient of the biasing force of spring 48 and the cross-sectional area of the pilot valve spool 44. In this way the pilot valve spool 44, subjected to low energy pressure signals, will act as an amplifying stage using the energy derived from the pump 10 to control the position and therefore the bypass action of the bypass spool 31. Leakage orifice 72, connecting the first control chamber 28 through passage 49 and the exhaust chamber 29 to the reservoir 12, is used, in a well known manner, to increase the stability of the pilot valve spool 44. If $P_2$ pressure is approximately equal to Pw pressure which is the case when the stem 65 is in the position fully displaced to the right from the as shown in FIG. 1, the bypass section 15*a*, by throttling fluid flow from the inlet chamber 26 to the bypass chamber 27, will automatically maintain a constant pressure differential $\Delta P$ between the pump pressure $P_1$ and $P_2$ pressure in the second control chamber 43 and with $\Delta Py$ becoming $\Delta P$, will also maintain a constant pressure differential across variable orifice 14. With constant pressure differential, acting across an orifice, the flow through an orifice will be proportional to the area of the orifice and independent of pressure in the fluid motor. Therefore, by varying the area of variable orifice 14, the fluid flow to the fluid motor 15 and velocity of the load W can be controlled, each specific area of variable orifice 14 corresponding to a specific velocity of load W, which will remain constant, irrespective of the variation in the magnitude of the load W.

In the arrangement of FIG. 1 the relationship between load pressure Pw and signal pressure $P_2$ is controlled by the combined action of the flow control section 17 and the signal throttling section 18. Fluid under $P_2$ pressure is conducted through passage 51 to the supply chamber 52 of the flow control section 17, from where it is throttled by throttling slots 58 on its way to the third control chamber 54. The control spool 56 will automatically assume a modulating position, in which it will sufficiently throttle fluid at $P_2$ pressure to a constant pressure level in the third control chamber 54, equivalent to the preload of the spring 62. Since a constant pressure level is automatically maintained in the third control chamber 54 and since the exhaust chamber 55 is maintained at a constant atmospheric pressure level, constant flow will take place through orifice 60, independent of $P_2$ pressure level. Therefore the flow control section 17 will automatically maintain a constant preselected flow level from the second control chamber 43. Therefore, in a well known manner, for each specific area of orifice, caused by displacement of metering slots 67, a constant specific pressure drop $\Delta Px$ will be maintained between Pw pressure and $P_2$ pressure, irrespective of the variation in Pw pressure. Under those conditions each specific position of stem 65 will correspond to a specific value of $\Delta Px$, which can be varied from Pw pressure level to zero pressure, each specific value of $\Delta Px$ being maintained constant and independent of Pw pressure. When referring to FIG. 1 it can be seen that $P_1-Pw=\Delta Py$, $P_1-P_2=\Delta P$, maintained constant by the bypass section 15*a* and $Pw-P_2=\Delta Px$. From the above equations, when substituting and eliminating $P_1$ and $P_2$ a basic relationship of $\Delta Py=\Delta P-\Delta Px$ is obtained. Since $\Delta Px$ can be varied and maintained constant at any level by the signal throttling section 18, so can $\Delta Py$, acting across variable orifice 14, be varied and maintained constant at any level. Therefore with any specific constant area of variable orifice 14, in response to control signal 71, pressure differential $\Delta Py$ can be varied from maximum to zero, each specific level of $\Delta Py$ being automatically controlled constant, irrespective of variation in the load pressure Pw. Therefore, for each specific area of variable orifice 14 the pressure differential, acting across orifice 14 and the flow through orifice 14 can be controlled from maximum to minimum by the signal modifying section composed of constant flow control section 17 and signal throttling section 18, each flow level automatically being controlled constant by the differential bypass control 13, irrespective of the variation in the load pressure Pw. From inspection of the basic equation $\Delta Py=\Delta P-\Delta Px$ it becomes apparent that with $\Delta Px=0$, $\Delta Py=\Delta P$ and that the system will revert to the mode of operation of conventional load responsive system, with maximum constant $\Delta P$ of the differential throttling control 13. When $\Delta Px=\Delta P$, $\Delta Py$ becomes zero, outlet pressure from the differential throttling control 13 $P_1$ will be equal to load pressure Pw and the flow through variable orifice 14 will become zero. With $\Delta Px$ larger than $\Delta P$, pressure $P_1$ will become smaller than load pressure Pw and the load check 21 will seat.

In the load responsive system of FIG. 1 for each specific value of $\Delta Py$, maintained constant by the signal throttling section 18 through the bypass section 15*a* of the differential bypass control 13, the area of variable orifice 14 can be varied, each area corresponding to a specific constant flow into the fluid motor 15, irrespective of the variation in the magnitude in the load pressure Pw. Conversely, for each specific area of the variable orifice 14 pressure differential $\Delta Py$, acting across orifice 14, can be varied by the signal throttling section 18, through the bypass section 15*a* of the differential bypass control 13, each specific pressure differential $\Delta Py$ corresponding to a specific constant flow into the fluid motor 15, irrespective of the variation in the magnitude of the load pressure Pw. Therefore fluid flow into fluid motor 15 can be controlled either by variation in area of variable orifice 14, or by variation in pressure differential. $\Delta Py$, each of those control methods displaying identical control characteristics and controlling flow, which is independent of the magnitude of the load pressure. Action of one control can be superimposed on the action of the other, providing a unique system, in which, for example, a command signal from the operator, through the use of variable orifice 14 can be corrected by signal 71 from a computing device, acting through the signal throttling section 18.

Referring now to FIG. 2 the flow control valve is similar in construction and performs in a similar way as that of FIG. 1. The bypass section, the pilot section and the flow control section of FIGS. 1 and 2 are identical. The signal throttling sections of FIGS. 1 and 2 represent different embodiments of the control, which provides similar control characteristics. The signal throttling section of FIG. 2, generally designated as 73, contains the solenoid, generally designated as 77, which consists of coil 75, secured in the housing 25 and the armature 76, slidably guided in the coil 75. The armature 76 is provided with conical surface 78, which, in cooperation with sealing edge 79, regulates the pressure differential $\Delta Px$ between inlet port 80 and passage 50. The sealed connector 84, in the housing 25, well known in the art, connects the coil 75 with external terminals, to which the external signal 85 can be applied. A solenoid is an electro-mechanical device, using the principle of electromagnetics, to produce output forces from electrical input signals. The force developed on the solenoid armature 76 is a function of the input current. As the current is applied to the coil 75, each specific current level will correspond to a specific force level, transmitted to the armature. Therefore, the contact force between the conical surface 78 of the armature 76 and sealing edge 79 of housing 25 will vary and be controlled by the input current. This arrangement will then be equivalent to a type of differential pressure throttling valve, varying automatically the pressure differential $\Delta Px$ between inlet port 80 and second control chamber 43, in proportion to the force developed in the armature 76, in respect to the area enclosed by the sealing edge 79 and therefore proportional to the external signal 85, of the input current supplied to the solenoid 77. The pressure forces acting on the armature 76, within the housing 25, are completely balanced with the exception of the pressure force due to the pressure differential $\Delta Px$ acting on the enclosed area of sealing edge 79. This force is partially balanced by the reaction force, developed on the cross-sectional area of the reaction pin 83, guided in a bore 82, which is connected through venting passage 81 with inlet port 80. The cross-sectional area of the reaction pin 83 must always be smaller than the area enclosed by sealing edge 79, so that a positive force, due to the pressure differential $\Delta Px$, opposes the force developed by the solenoid 77. The reaction pin 83 permits use of larger flow passages, while also permitting a very significant reduction in the size of solenoid 77, also permitting the solenoid 77 to work in the higher range of $\Delta Px$. The second control chamber 43 is connected to the flow control section 17.

The schematically shown actuator 70 of FIG. 1 may respond to may types of external control signals 71. The stem 65 can be manually operated through a mechanical linkage. The actuator 70 may be of a hydraulic or pneumatic type, responding to a hydraulic or pneumatic external control signal, it may be a solenoid or a torque motor, responding to an electrical input current signal, or it may be a stepper motor, responding to a digital electrical external control signal.

FIGS. 1 and 2 show a dual input flow control system supplying a fluid motor operating a load W. In such a system the check valve 21, preventing reverse flow from the fluid motor may be of some value. It should be noted that location of the check valve 21, in the position as shown, or in line 22 past port 42, will to some degree change the operating conditions of the flow control. With the check valve 21 in position as shown in FIGS. 1 and 2, variable orifice 14 open and $\Delta Px$ larger than $\Delta P$, the pilot section 16 will be operated by power derived from load W and $P_1$ will equal zero, with the pump 10 completely unloaded. With the check valve 21 mounted in the other position the port 42 will be isolated from Pw, when $\Delta Px$ is larger than $\Delta P$ and the pump pressure will be $P_1 = Pw - \Delta Px + \Delta P$. When $Pw = \Delta Px$, $P_1$ becomes equal to $\Delta P$, this being the lowest operating pressure of the pump 10. With variable orifice 14 closed or with load W becoming zero, irrespective of the position of the check valve 21, pump pressure $P_1$ will automatically drop to the fixed value of $\Delta P$. The flow control valves of FIGS. 1 and 2 may control the fluid flow to other devices than fluid motor, for example fuel flow to fuel nozzle or flow of fluid used in a chemical process or mixing operation. In such instances the flow to the device can be controlled, at all Pw pressure levels, at constant $\Delta Py$ by variation in flow area of orifice 14. The flow can also be controlled by variation in $\Delta Py$, but that can be accomplished at Pw pressure levels higher than $\Delta P$. If control of $\Delta Py$ at Pw values lower than $\Delta P$, a constant pressure differential throttling device, in the form for example of a spring loaded check, located down stream of variable orifice 14 and throttling the fluid flow to the device, at a level higher than $\Delta P$, can be inserted in line 23. In this way Pw can not drop below the minimum value of $\Delta P$.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly comprising a housing having an inlet chamber connected to a pump and to a device supplied with pressure fluid, a bypass chamber connected to fluid exhaust means, control orifice means interposed between said inlet chamber and said device supplied with pressure fluid, first valve means having fluid throttling means between said inlet chamber and said bypass chamber controllable by a pilot valve means and operable to throttle fluid flow from said inlet chamber to said bypass chamber to maintain a constant pressure differential at a preselected constant level across said pilot valve means and to maintain a constant pressure differential across said control orifice means, and second valve means having means operable through said first valve means to vary the level of said constant pressure differential across said control orifice means while said pressure differential across said pilot valve means remains constant at said constant predetermined level.

2. A valve assembly as set forth in claim 1 wherein said control orifice means has variable area orifice means.

3. A valve assembly as set forth in claim 1 wherein said second valve means includes constant flow control means.

4. A valve assembly as set forth in claim 3 wherein said second valve means includes fluid throttling orifice means upstream of said constant flow control means.

5. A valve assembly as set forth in claim 4 wherein said orifice means has variable area orifice means.

6. A valve assembly as set forth in claim 1 wherein said second valve means includes fluid throttling means and constant flow control means down stream of said fluid throttling means.

7. A valve assembly as set forth in claim 1 wherein said second valve means has means responsive to an external control signal.

8. A valve assembly comprising a housing having an inlet chamber connected to a pump and to a device supplied with pressure fluid, a bypass chamber connected to fluid exhaust means, control orifice means interposed between said inlet chamber and said device supplied with pressure fluid, first and second control chambers in said housing, first valve means having fluid throttling means between said inlet chamber and said bypass chamber provided with means responsive to pressure in said first control chamber, and pilot valve means operable to control pressure in said first control chamber having means responsive to pressure in said second control chamber and to pressure in said inlet chamber, said first valve means operable to throttle fluid flow from said inlet chamber to said bypass chamber to maintain a constant pressure differential at a preselected constant level between said inlet chamber and said second control chamber and across said pilot valve means and to maintain a constant pressure differential across said control orifice means, pressure signal transmitting means operable to transmit control pressure signal from downstream of said control orifice means to said second control chamber, and modifying means of said control pressure signal operable through said first valve means to vary the level of said constant pressure differential controlled across said control orifice means while said pressure differential between said inlet chamber and said second control chamber remains constant at said constant predetermined level.

9. A valve assembly as set forth in claim 8 wherein said modifying means of said control pressure signal includes flow orifice means and a pressure responsive flow control means down stream of said flow orifice.

10. A valve assembly as set forth in claim 8 wherein said modifying means of said control pressure signal includes fluid throttling means and flow control means down stream of said fluid throttling means communicable with said exhaust means.

11. A valve assembly as set forth in claim 8 wherein said modifying means of said control pressure signal has means responsive to an external control signal.

* * * * *